United States Patent [19]

Mouissie

[11] 4,227,767

[45] Oct. 14, 1980

[54] ELECTRICAL CONNECTOR FOR PRINTED CIRCUIT BOARDS

[75] Inventor: Bob Mouissie, Berlicum, Netherlands

[73] Assignee: E. I. Du Pont de Nemours and Company, Wilmington, Del.

[21] Appl. No.: 68,350

[22] Filed: Aug. 21, 1979

Related U.S. Application Data

[63] Continuation-in-part of Ser. No. 919,738, Jun. 27, 1978, abandoned.

[30] Foreign Application Priority Data

Jun. 30, 1977 [NL] Netherlands ..... 777268

[51] Int. Cl.[3] ..... H01R 13/16

[52] U.S. Cl. ..... 339/176 MF

[58] Field of Search ..... 339/17 F, 176 MF

[56] References Cited

U.S. PATENT DOCUMENTS 3,614,707 10/1971 Kaufmann ..... 339/176 MF 3,873,172 3/1975 Paullus ..... 339/176 MF

FOREIGN PATENT DOCUMENTS 1194539 6/1970 United Kingdom ..... 339/176 MF

*Primary Examiner*—Joseph H. McGlynn

[57] ABSTRACT

An improved electrical connector including dual contacts comprising an insulating support, an arcuately stressed spring having each end confined within the support, and a flexible printed circuit stretched over the spring is provided. The contact function is accomplished by the flexible circuit. The spring is adapted to deflect and resiliently flex at its midpoint during engagement with a mating contact at which time the spring surfaces on both sides of their midpoints resiliently press the flexible circuit against the mating contact. The resilient flexure of the spring provides redundant pressure points between the flexible printed circuit and the mating contact and eliminates the need for a spring having both the sufficient resilience and the necessary conductive properties.

9 Claims, 5 Drawing Figures

ELECTRICAL CONNECTOR FOR PRINTED CIRCUIT BOARDS

PRIOR APPLICATION

This application is a continuation-in-part of my prior application Ser. No. 919,738, filed June 27, 1978, now abandoned.

DESCRIPTION

TECHNICAL FIELD

The invention relates to an electrical connector for printed circuit board and more particularly to a dual contact connector having springs covered by a flexible printed circuit.

BACKGROUND ART

Dual metal contacts are described in Mancini, U.S. Pat. No. 3,317,888, issued May 2, 1967, and in Berg, U.S. Pat. No. 3,370,265, issued Feb. 20, 1968. The aforementioned patent describes a dual or bi-metallic circuit board pin comprising a base and a spring metal contact leaf. The contact leaf is fixedly mounted to the base at one end and retained by a hook on the base at the other end. The latter mentioned patent describes a contact comprising a socket and a bowed contact spring. The contact spring is confined in the socket but is free to move relative to the socket. In both of these contacts, the base or socket can be made of a malleable metal of high electrical conductivity such as brass, copper or phosphor bronze, and the spring can be made of a resilient spring metal such as spring steel, beryllium copper or other spring metals or alloys. Both the base or support and the spring can be plated or coated with a corrosion resistant layer such as gold or tin-lead, to assure a good electrical contact between the contact and a mating contact. In both of the above contacts the spring is bowed and, upon engagement with a mating contact, the spring is deflected and flattened at its midpoint to provide a flat area of contact between the spring and mating contact with a force proportional to the deflection of the spring. A plug jack connector is described in Klassen, U.S. Pat. No. 3,273,105, issued Sept. 13, 1966. The connector includes a contact having two spaced bends on both sides of its midpoint.

An electrical connector having a contact comprising a support and an arcuately stressed plate spring having each end fixedly mounted to the support where the spring is adapted to deflect and flex at its midpoint during engagement by a mating contact is described in Ser. No. 755,128, filed Dec. 28, 1976 to B. Mouissie (U.S. Pat. No. 4,109,986). During the operation of the above-described connector, the spring surfaces on both sides of the spring's midpoint provide the contact surfaces with a mating contact. Potential disadvantages arise from the difficulty in obtaining springs having both the necessary malleability and conducting properties or, if plated, in maintaining good electrical contact between spring and mating contact and from the increased contact resistance resulting from repeated insertions and removals of the mating contact damaging the surface plating.

DISCLOSURE OF THE INVENTION

The electrical connector for mating contacts of this invention comprises a dielectric housing having a slot extending along the length thereof, a plurality of opposed pairs of springs confined within said housing and a flexible printed circuit stretched over each pair of springs, said springs being restrained in an arcuately stressed condition and thereby adapted to deflect and resiliently flex at their midpoints during insertion of a mating contact into said slot and to provide redundant (two) pressure points between said flexible printed circuit and the mating contact.

Such an arrangement utilizes the plate springs for their spring action only while the contact function is taken over completely by the flexible conductive strips of the printed circuit.

Well conducting contact strips, such as copper, printed parallel on a flexible sheet comprise the flexible printed circuit. Suitable flexible materials for the flexible sheet include polyester films such as high molecular weight polyethylene glycol terephthalate, known as Mylar® polyester film or Kapton® polyimide (registered trademarks of E. I. du Pont de Nemours & Co.).

The flexible printed circuits utilized in this invention provide good resilient contact with a mating contact such as a printed circuit board or edgecard on the one hand and with further connectors such as pins, on the other hand. These latter contacts can be secured in place by a soldered connection.

DESCRIPTION OF THE INVENTION

A preferred embodiment of a printed circuit board connector of this invention is described below with reference to the attached drawings wherein the same numerals are used throughout the various views to illustrate the same elements. The connector shown in FIGS. 1 and 2 comprises two opposed identical halves which mate when one is inverted as shown.

Figure 1:
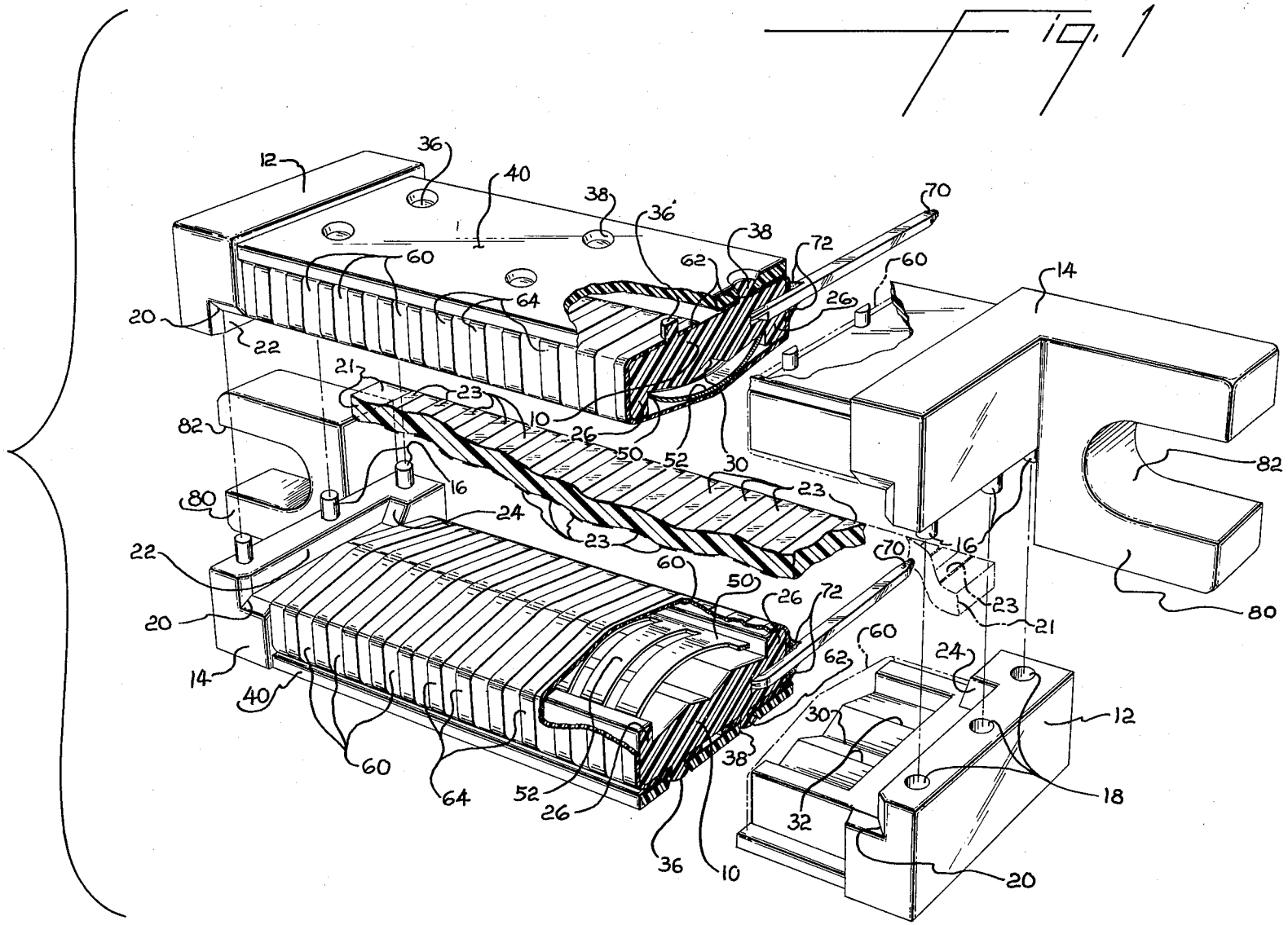
FIG. 1 is an exploded perspective view of a preferred embodiment of the invention illustrating a printed circuit board connector.

A circuit board connector having dielectric housing of mating blocks 10 with a plurality of opposed pairs of plate springs 52 confined within and flexible printed circuits 60 stretched over the springs is illustrated in FIG. 1.

The dielectric housing blocks 10 are limited at both ends by vertical ends 12 and 14. As a result of the inversion of the two halves of the connector, the vertical end 12 of the upper block is opposite the vertical end 14 of the lower block and vice versa.

Figure 2:
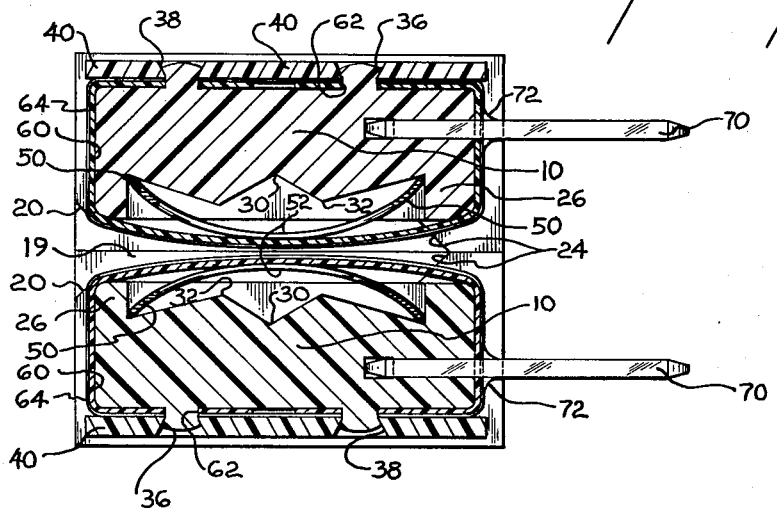
FIG. 2 is a sectional elevation of the connector of FIG. 1.
Figure 3:
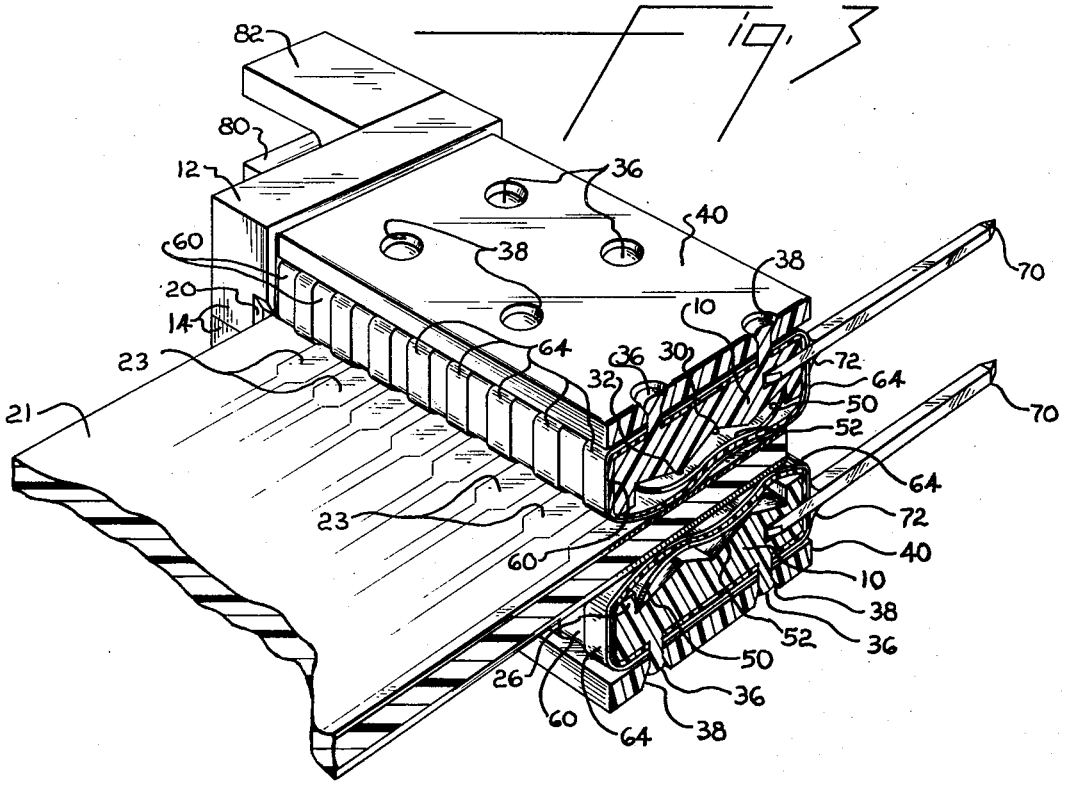
FIG. 3 is a partially cutaway perspective view illustrating the dual contact position of the plate springs upon insertion of a circuit board into the closed connector of FIG. 1.

The vertical ends 14 have locking pins 16 which fit in locking holes 18 of the vertical ends 12. In this way the two halves can be locked to each other. The thickened parts of the vertical ends 12 and 14 define a slot space 19 extending along the length of the dielectric housing for the insertion of a mating contact 21 therebetween. The ends 12 and 14 have at the front side of the slot 19 bevelled corner edges 20 to facilitate the insertion of a mating contact which is guided further by the projecting guiding surfaces 22. At their rear end, the vertical ends 12 and 14 have bevelled stopping surfaces 24. The stopping surfaces 24 of the ends 12 and 14, when assembled, limit the insertion of a mating contact to a certain depth, as can be seen in FIG. 2.

Dielectric blocks 10 have on opposed faces foremost and hindmost vertical supporting ledges 26. Between supporting ledges 26 the blocks have profiles showing apex 30 at both sides of which there are two inversely directed apices 32.

On the outer faces of blocks 10 there are pins 36 which fit in holes 38 of insulating cover plates 40, which are mounted on these upper faces.

Between the two projecting ledges 26 of each 5 block 10, a plate spring is arcuately stressed, the spring comprising continuous side strips 50 with connecting cross parts 52 therebetween, each cross part serving as a separate spring. The curved portions of cross parts 52 extend into the slot space 19.

Flexible printed circuit 60 is stretched over the spring parts 52 and around the sides and outer face of block 10. The flexible printed circuit 60 is secured in place by having pins 36 of each block 10 passing through securing holes 62 of the printed circuit which are in registry with holes 38 of cover plates 40. Each flexible circuit 60 is coated with parallel copper conducting strips 64, in such a manner that each connector spring part 52 presses against the underside of flexible circuit 60 in registry with a corresponding strip 64.

Figure 4:
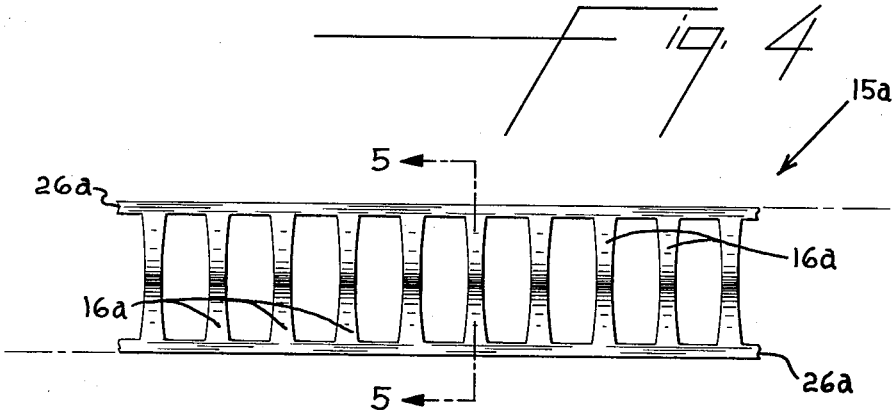
FIG. 4 is a perspective view of a preferred plate spring used in the connector shown in FIG. 3.
Figure 5:
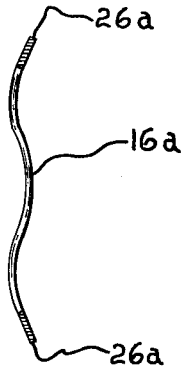
FIG. 5 is a sectional view of the plate spring shown in FIG. 4 taken along 5—5 of FIG. 4.

A preferred plate spring 15*a* is shown in FIGS. 4 and 5. This plate spring has continuous side strips 26*a* corresponding to the like strips 50 described above. The cross parts 16*a* differ from the cross parts 52 of the prior mentioned plate spring in that they have an hourglass figure as opposed to the rectangular shape of the cross parts 52. This shape facilitates the formation of the desired redundant contact points upon insertion of the circuit board 21. FIG. 5 shows that the cross parts 16*a* of spring 15*a* are also partially preformed to provide the redundant contact surfaces prior to insertion into the connector.

At the sides of both blocks 10, away from the slot space 19, in holes provided for that purpose, pins 70 are inserted through the conducting strips 64. Each pin 70 corresponds to a conducting strip 64 of the flexible circuit 60. A good contact connection between the respective pins 70 and the corresponding contact strips 64 can be established by solder connections 72.

The assembly of the above-described electrical connector can be readily accomplished. The plate springs are inserted into blocks 10 and stressed between projecting ledges 26. Then the flexible circuits are stretched thereover, followed by the attachment of cover plates 40. Finally pins 70 are arranged in two parallel rows (for the sake of clarity, FIG. 1 shows only two corresponding pins 70), inserted in blocks 10 and soldered at solder connections 72 to the conducting strips 64 of the flexible circuits 60. After this step, the two blocks 10 are brought together so that locking pins 16 fit into locking holes 18 to complete the assembly. Mounting flange 80, having a receiving slot 82, allows the attachment of the electrical connector of this invention to other parts by means of a screw or bolt.

For operation, a mating contact such as a printed circuit board 21 having edge contact strips 23 on both sides is inserted in the slot space 19 extending along the length of the dielectric housing. The various contact strips of the printed circuit board press against the conducting strips 64 of the flexible circuit 60. The insertion of the board causes deflection and resilient flexing of plate springs 52 around their midpoints. The dual crested shape of the springs assumed during this flexing is accommodated by the blocks' profile having apices 30 and 32 and provides the redundant pressure points, corresponding to the location of apices 32, between the flexible printed circuit of the connector of this invention and the mating contact.

While the embodiment according to FIGS. 1 and 2 as described above is considered to be the best mode of the present invention, other embodiments are described below.

The plate spring described above has a rectangular shape. It is contemplated that springs having other shapes, such as elliptical, can also be utilized in the present invention so long as they can be arcuately stressed between the supporting edges of the blocks.

It is further contemplated that the profile of the insulating block between its supporting edges can be curvilinear having a trough at or near its midpoint and two crests at either side of the midpoint.

Additionally, the connector of this invention can accommodate pins as mating contacts when there is at least one pair of opposed springs confined within each block 10.

I claim:

1. An electrical connector for a mating contact comprising a dielectric housing having a slot extending along the length thereof, at least one pair of opposed pairs of springs confined in said housing and flexible printed circuits covering said springs, said springs being restrained in an arcuately stressed condition and thereby being adapted to deflect and resiliently flex at their midpoints during insertion of a mating contact into said slot causing each spring to form a dual crested shape and thereby provide redundant pressure points between said flexible printed circuit and the mating contact.

2. The electrical connector of claim 1 wherein said dielectric housing comprises two substantially indentical blocks each having thickened vertical ends defining said slot.

3. The electrical connector of claim 1 adapted for insertion of a mating contact which is a printed circuit board having contact strips on both sides.

4. The electrical connector of claim 1 wherein said flexible printed circuit is a polyester film having parallel conducting strips on its surface.

5. The electrical connector of claim 1 further comprising pins inserted in said dielectric housing through said conducting strips and soldered thereto.

6. The electrical connector of claim 1 wherein said springs have rectangular or elliptical cross sections.

7. The electrical connector of claim 6 wherein said springs are connecting cross parts between continuous side strips, said side strips being confined in the dielectric housing.

8. An electrical connector for a printed circuit board comprising a dielectric housing in two halves, the housing having thickened vertical ends defining a slot space extending along the length of the connector, foremost and hindmost supporting ledges and a cross section having a profile adapted to accommodate springs as they reform during insertion of said circuit board; a plurality of opposed pairs of springs arcuately stressed between said supporting ledges, wherein the springs are connecting cross parts between continuing side strips and adapted to deflect and resiliently flex at their mid-points into a dual crested shape during insertion of said circuit board; and a flexible printed circuit covering said springs in each housing half, said printed circuit being a polyester or polyimide film having parallel conducting strips on its surface.

9. The electrical connector of claim 8 further comprising pins inserted in said dielectric housing through said conducting strips and soldered thereto and insulating cover plates mounted on the outer faces of said housing.

* * * * *